US005975303A

United States Patent [19]

Morell

[11] Patent Number: 5,975,303

[45] Date of Patent: Nov. 2, 1999

[54] BUMPER FOR PROTECTING OBJECTS

[76] Inventor: Ramon B. Morell, 46 Bradford Rd., East Brunswick, N.J. 08816

[21] Appl. No.: 09/107,266

[22] Filed: Jun. 30, 1998

[51] Int. Cl.[6] ..... B65D 85/48; B65D 81/02

[52] U.S. Cl. ..... 206/453; 206/586; 229/120.1; 248/345.1

[58] Field of Search ..... 206/453, 586, 206/592, 588; 248/345.1; 229/120.12

[56] References Cited

U.S. PATENT DOCUMENTS

| | | | |
|---|---|---|---|
| 2,808,177 | 10/1957 | Buttery | 229/120.12 |
| 3,443,684 | 5/1969 | Taylor | 206/60 |
| 3,655,112 | 4/1972 | Jeffers | 229/14 |
| 3,843,038 | 10/1974 | Sax | 229/14 |
| 4,134,496 | 1/1979 | Smith | 206/586 |
| 4,372,446 | 2/1983 | Konopko | 206/586 |
| 4,375,852 | 3/1983 | Johnston et al. | 206/586 |
| 4,385,698 | 5/1983 | Goguen | 206/586 |
| 4,440,304 | 4/1984 | Konopko | 206/586 |
| 4,529,091 | 7/1985 | Martin | 206/586 |
| 5,782,357 | 7/1998 | Johnson | 206/461 |

*Primary Examiner*—Paul T. Sewell
*Assistant Examiner*—J. Mohandesi
*Attorney, Agent, or Firm*—Duane, Morris & Heckscher LLP

[57] ABSTRACT

A paperboard bumper is made from a die cut blank. Material is provided for two outer layers and two intermediate layers, the four layers overlying each other when the blank is collapsed flat. A first fold line extends longitudinally across the blank, and defines a folding and unfolding axis that corresponds to an outside corner of the bumper when erected. A tab is secured to each of the intermediate layers adjacent to a void in the blank. When folded flat the tabs are glued together and the void is collapsed. The intermediate layers are glued to the outer layers at opposing surfaces and form first and second walls when the blank is erected. Transverse fold lines extend on the walls, one positioned to either side of the tabs. A hollow chamber is formed between the transverse fold lines, extending along the walls, when the device is erected by unfolding it along the first fold line. The transverse fold lines are spaced from each other by a distance equal to the width of the tabs, so that the tabs are received in the hollow chamber to lock the erected device in a stable position.

19 Claims, 5 Drawing Sheets

BUMPER FOR PROTECTING OBJECTS

BACKGROUND OF THE INVENTION

1. Field of the Invention

The invention relates to structures for cushioning and protecting objects, for example when being stored or moved in cartons, and more particularly provides a bumper made from a folded and glued sheet material blank.

2. Prior Art

Many types of objects need to be protected from jarring, jolting, and resultant damage when they are packaged in cartons for transportation, shipment, or other transit. It is known to provide cartons and shipping containers with bumpers, sleeves, or similar inserts that are placed in a space between an object to be shipped and the walls of the surrounding container. In a rectilinear carton and/or to protect a generally rectilinear object, such inserts can be placed at each corner. Other shapes are also possible such as larger shapes that fit all around the object, or at least form a partial shell. The inserts have a certain resilience to cushion the object against impacts against the container, and may also contribute to the structure of the container and strengthen it for stacking.

An often encountered form of these bumpers or inserts is polystyrene foam in blocks sized and shaped to complement both the selected outer contours of the object to be protected and the inner walls of the container. It is also known to use pellets or other loose fill material, again generally made of polystyrene foam, to occupy the void space between an object to be protected and the surrounding carton.

Polystyrene foam cushioning material has certain disadvantages. For example, polystyrene insert cushioning blocks are generally made from a mold or die, which may be unique to a particular object to be shipped. Shipping different objects may require different individual dies to make appropriately sized and shaped blocks. The need to make and stock polystyrene and similar blocks can be expensive.

In addition, polystyrene and other formed block inserts, once formed are bulky items to ship to the packing facility and to store and use. This bulkiness becomes especially significant when dealing with a high volume packing facility which would require a significant number of polystyrene inserts to place in boxes as they are being loaded with the objects to be shipped. On the receiving end, after the objects are unpacked, the bulky blocks must be disposed of.

Another disadvantage of polystyrene bumpers and inserts is that they protect the object by completely filling selected void spaces between the object and the carton. The void spaces filled and occupied by the polystyrene are unavailable for packing additional components. In other words, it would be desirable adequately to protect an object to be shipped but also to leave space, if possible, which can be used to ship other components in the same carton.

It is known to use corrugated paperboard sheet material as a protective spacer, including to protect corners of articles from damage. Examples of such corner protectors are shown in U.S. Pat. Nos. 4,134,496—Smith; 4,440,304—Konopko; and 4,529,091—Martin.

Such corrugated corner protectors have their own drawbacks. Often the protectors require folding sheet material into L-shapes, rolled boxes and the like, which are then fit between the object and the container. Various folding operations may be needed to form the protector from flat sheet stock materials. Such corner protectors may be ill-suited to be folded by machine operations and instead require manual folding operations. A corner protector which is complicated to assemble from its sheet blank, and/or which requires manual folding operations for such assembly, can be prone to being assembled incorrectly. In addition, complicated manual folding operations require time to execute and can be inefficient.

Known corner protectors using corrugated paperboard generally rely on the combination of resilience and support of the corrugated sheet material itself to provide the cushioning needed to protect the object while supporting it at a spaced from a container wall. Corrugated sheet material in some applications does not provide the required protection.

There is a need for a bumper or insert which overcomes such drawbacks and disadvantages. Such a bumper or insert should be relatively inexpensive to manufacture, relatively adaptable to different products or objects to be protected, easy to ship, and easy to assemble.

SUMMARY OF THE INVENTION

It is an object of the present invention to provide a corrugated bumper and associated blank for protecting an object to be transported or shipped.

A blank for a corrugated bumper, according to the present invention, includes at least two outer layers of corrugated sheet material and at least two intermediate or inner layers between those outer layers. The four layers substantially overlie each other when the blank is in a collapsed state so that the blank is substantially flat prior to erection to form a supportive spacer body. The blank has one fold line which extends longitudinally across the blank and defines a longitudinal axis. The blank folds and unfolds along such longitudinal axis and the longitudinal axis and fold line correspond to a corner of the blank when the blank is erected and deployed. The blank includes tabs which extend from the intermediate layers in a generally transverse direction and terminate near the longitudinal axis. The tabs have opposing planar surfaces which are secured to each other. The intermediate layers are glued to outer layers at respective opposing surfaces thereof and thus form two walls when the blank is deployed. A pair of transverse fold lines extend transversely on either side of the tabs and assist in defining a hollow chamber when the blank is unfolded along the longitudinal fold line.

According to another aspect of the invention, certain of the tabs fit perpendicularly into openings between other walls that separate from one another, for example along a fold line. By inserting a tab between these walls the blank is locked in the erected state because the walls cannot collapse back around the fold line.

The bumper includes first and second walls which are connected to each other at a common edge. The hollow chamber is defined adjacent to the walls by a plurality of panels extending therefrom. The tabs defining each of the walls are insertable into the hollow chamber to lock the bumper in an erected condition for deployment.

In another embodiment the invention relates to a blank with a pair of the longitudinal fold lines. In this embodiment, one fold line is at each of the side edges of the blank. A wall extends from each of the fold lines and a third wall extends between the fold lines. In this way, the first, second and third walls and the fold lines define a cavity which can receive an end of an object to be protected.

In still another version, the blank includes four of the longitudinal fold lines and four wall portions extending between respective pairs of the fold lines. As such, the blank defines an enclosed region when deployed and an object can be fit into this region for protection and cushioning around four sides.

BRIEF DESCRIPTION OF THE DRAWINGS

There are shown in the drawings several exemplary embodiments of the invention as presently preferred. It should be understood that the invention is not limited to these particular embodiments and is capable of variations within the scope of this disclosure and the appended claims. In the drawings.

DETAILED DESCRIPTION OF THE PREFERRED EMBODIMENTS

Figure 1:
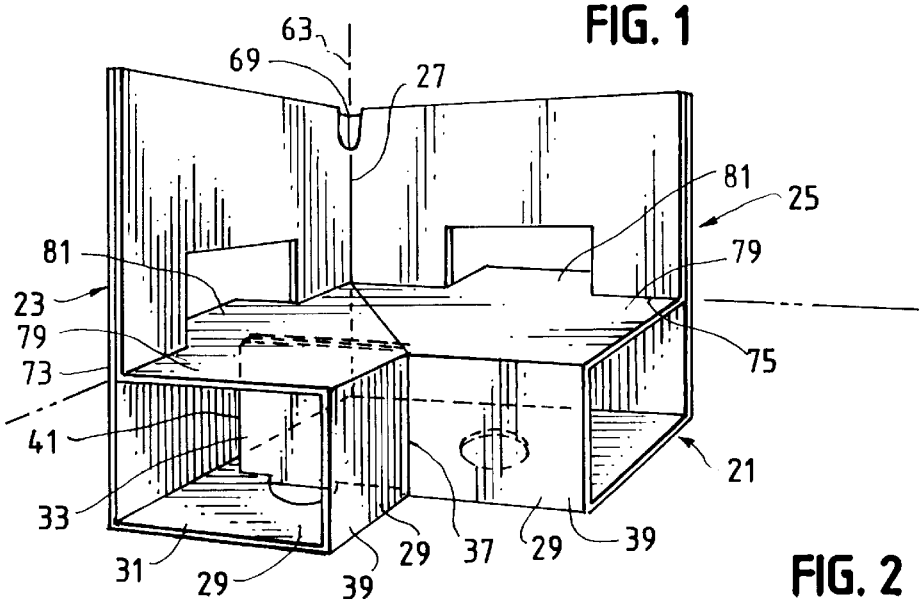
FIG. 1 is a perspective view of a bumper incorporating the principles of the invention.

Referring to FIGS. 1–7, a bumper 21 for protecting an object to be shipped includes a first wall 23 and a second wall 25 connected to each other at a common edge 27. The bumper 21 is preferably made of corrugated craft or similar sheet material.

Bumper 21 includes various panels 29 arranged to define a hollow chamber 31. Hollow chamber 31 open automatically when the blank for bumper 21 is erected for deployment. This is accomplished by means of a pair of tabs 33 in a manner discussed in more detail below. Tabs 33 are adhered to each other along opposing planar surfaces 35 (FIG. 2), which forms a fold at the fold line between panels 23, 25. Initially, bumper 21 is folded flat and glued. The fold line between panels 23, 25 can be opened out, to a right angle in this embodiment, at the same time that hollow chamber 31 and its counterpart on the other panel are raised from folded flat to a rectilinear shape.

Figure 5:
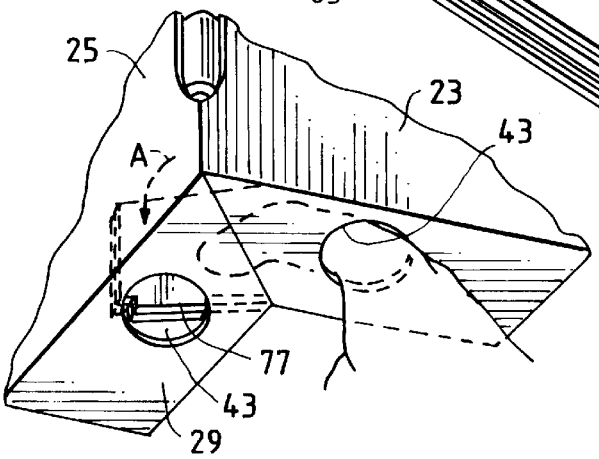
FIG. 5 is a partial perspective view showing the blank of FIG. 1, having been erected and shown being locked in position for deployment.

When the bumper 21 is fully erected as shown in FIG. 1, tabs 33 extend from opposing edges 37 of inner panels 39 into hollow chamber 31. Tabs 33 terminate at edges 41. Tabs 33 are sized so that they can be rotated as a unit along the axis defined by opposing edges 37. In this embodiment, as best seen in FIG. 5, tabs 33 are rotated until they are positioned in alignment with a circular opening 43. In this position, a short tab or flange 45 which extends downwardly from the tabs 33 is received in circular slot 43 and assists in "locking" bumper 21 in an erect position shown in FIG. 1. As best seen in FIG. 5, the tabs 33 can be rotated into position over one of the circular slots 43 by inserting a finger into the other of the slots 43 and applying pressure in the direction indicated by the arrow A to the surfaces of tab 33. In this manner, bumper 21 is erected from a folded glued blank and locks into a stable shape suitable for overlying a portion of the object to be protected, such as a corner.

Figure 2:
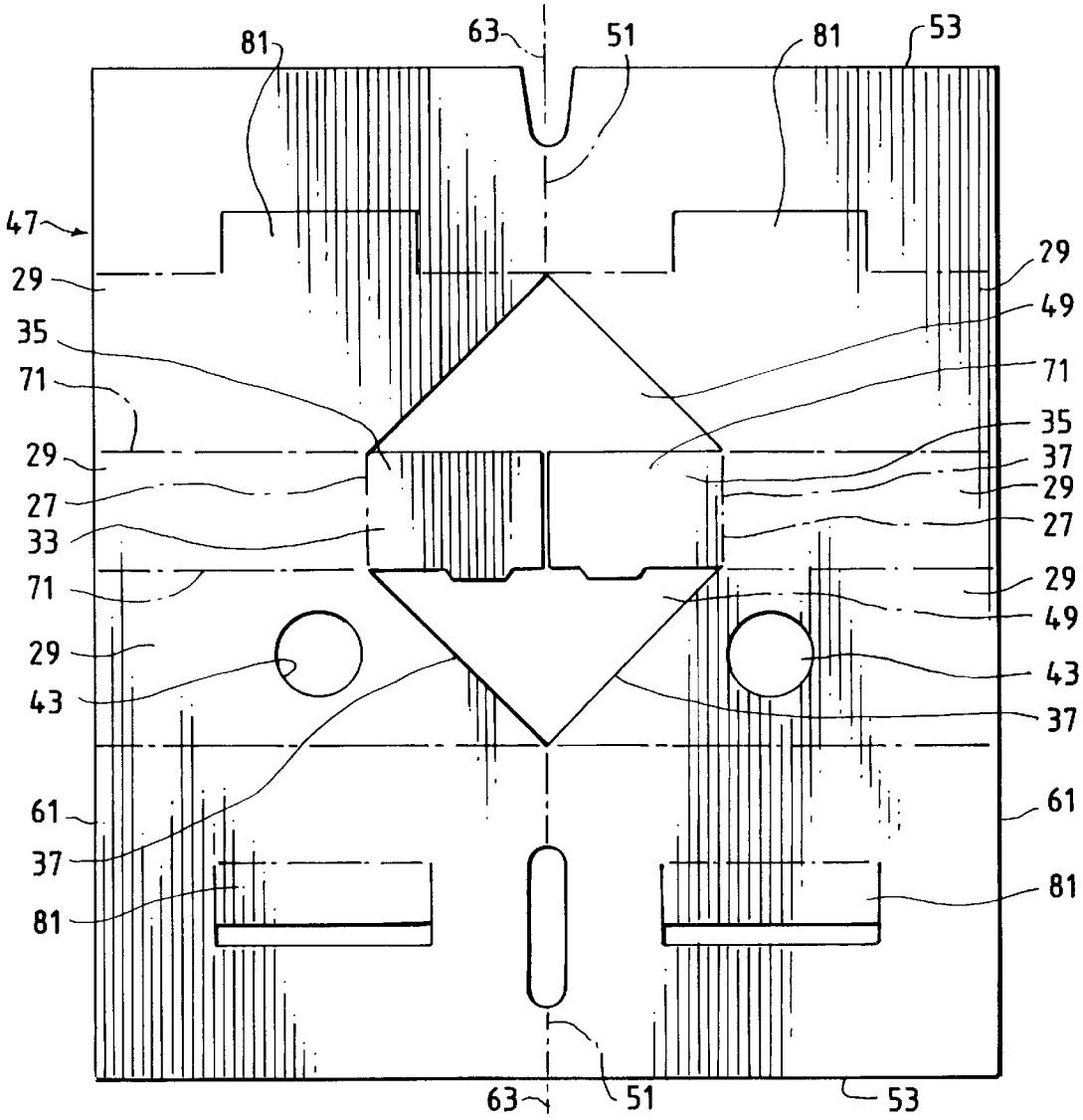
FIG. 2 is a top plan view of a sheet of corrugated material used to form the bumper of FIG. 1 which has been die-cut with a suitable pattern of score lines, perforations and/or voids.
Figure 3:
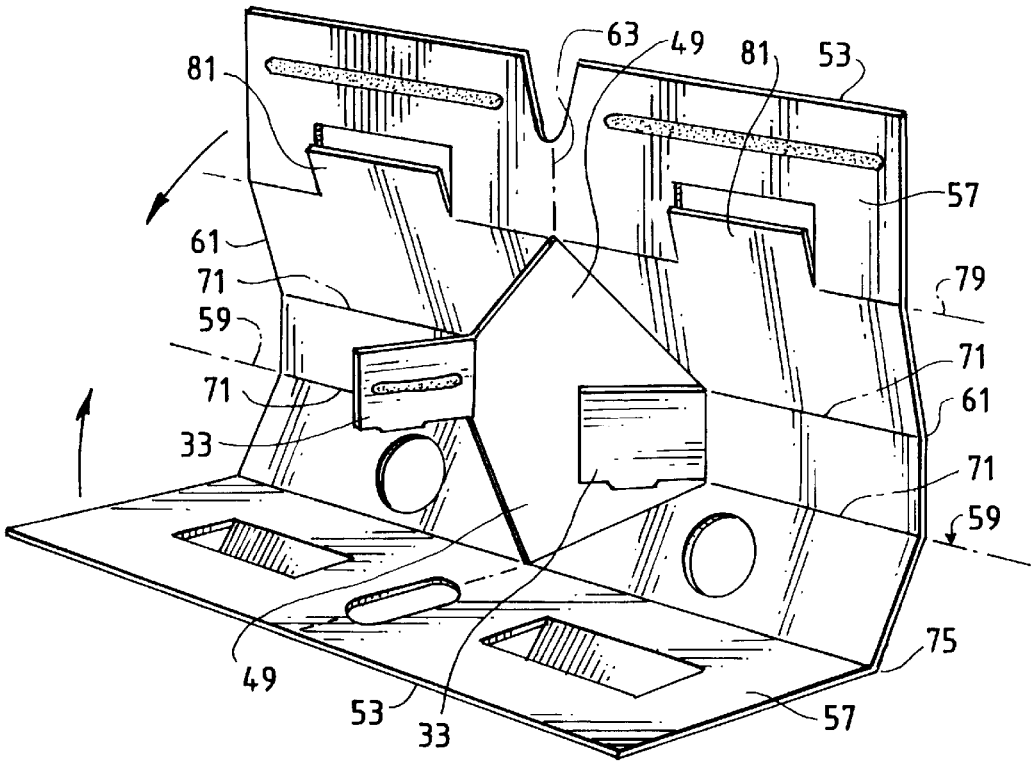
FIG. 3 is a perspective view showing the die-cut sheet material of FIG. 2 being folded to create a blank for the corrugated bumper of FIG. 1.
Figure 4:
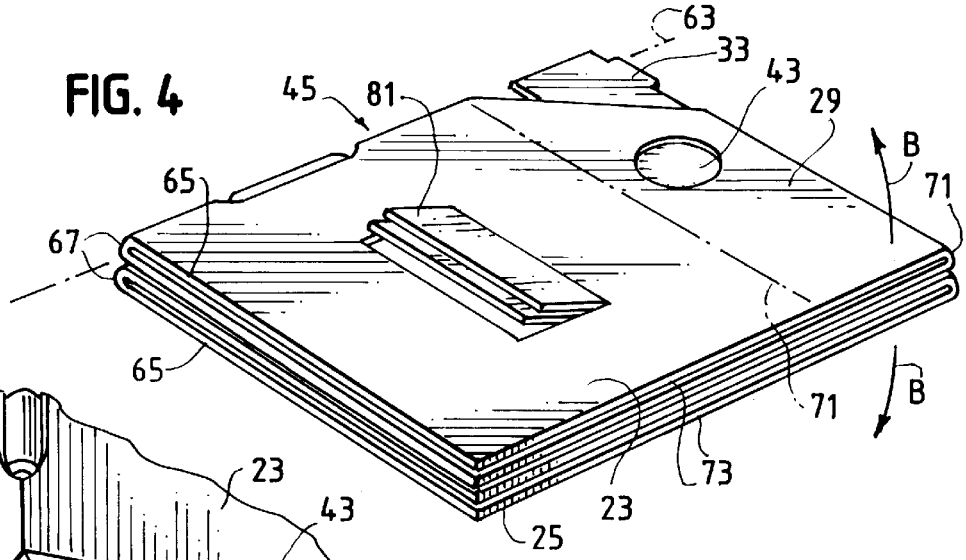
FIG. 4 shows the finished blank for the corrugated bumper of FIG. 1 after it has been assembled from the sheet material shown in FIGS. 2 and 3.

Bumper 21 is readily formed from a glued blank 45, shown in FIG. 4. Glued blank 45, in turn, is formed from die-cutting, patterning, and folding a single integral sheet of material as shown in FIGS. 2 and 3. To form the blank 45 (FIG. 4), a sheet of material 47, preferably any of a variety of corrugated grades, is die-cut to provide a pair of triangular shaped voids 49. Triangular voids 49 are located on opposite sides of Tabs 33 and when the bumper is erected the voids become closed with their edges abutting along the midline 63. Tabs 33 have been suitably die-cut as shown and have their respective tab edges 41 proximate to each other and opposed to each other when disposed on the sheet 47 shown in FIG. 2. A score or fold line 51 extends between upper and lower edges 53 of sheet 47 and intersects with apices 55 of triangular voids 49.

At appropriate times during the folding and gluing operations related to sheet 47, adhesive is selectively applied to at least one of the planar surfaces 35 of one of the tabs 33 and also to one of the edge regions 57, preferably near the upper one of the edges 53 (FIG. 3). Sheet 47 is then folded by a suitably adjusted folding apparatus for corrugated material so that edges 53 are moved toward each other and opposing sheet regions 57 are brought into contact with each other. In this case, folding takes place along a transverse axis 59 located just below corresponding sides of tabs 33.

Next, side edges 61 are folded toward each other along the longitudinal axis 63 corresponding to score line 51. This folding operation brings planar surfaces 35 of tabs 33 into an opposing and contacting relationship with each other. Adhesive is applied during or prior to this folding operation so that the contacting surfaces 35 of tabs 33 remain attached and effectively form one double thickness tab.

The above-described operations are simple enough to be readily accomplished by suitably set up and adjusted fold-and-glue apparatus through which the blanks are fed.

The resulting glued blank 45 (FIG. 4) is now described. The blank 45 is substantially planar in configuration and thereby efficient to ship in large quantities when in the flattened or unerected state shown in FIG. 4. There are two outer layers 65 and two intermediate layers 67 between the outer layers 65. When the blank is in the collapsed state as in FIG. 4, the four layers. 65, 67 substantially overlie each other.

Figure 6:
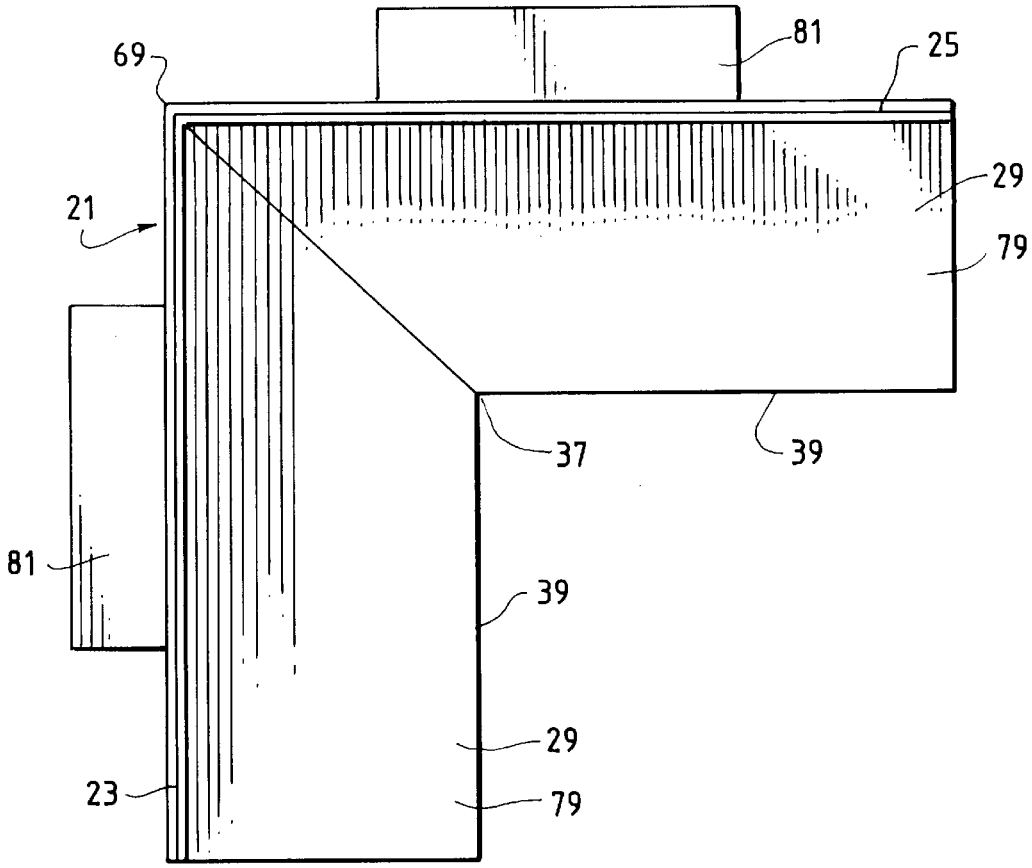
FIGS. 6 and 7 are top plan and side elevational views of the blank of FIG. 1.
Figure 7:
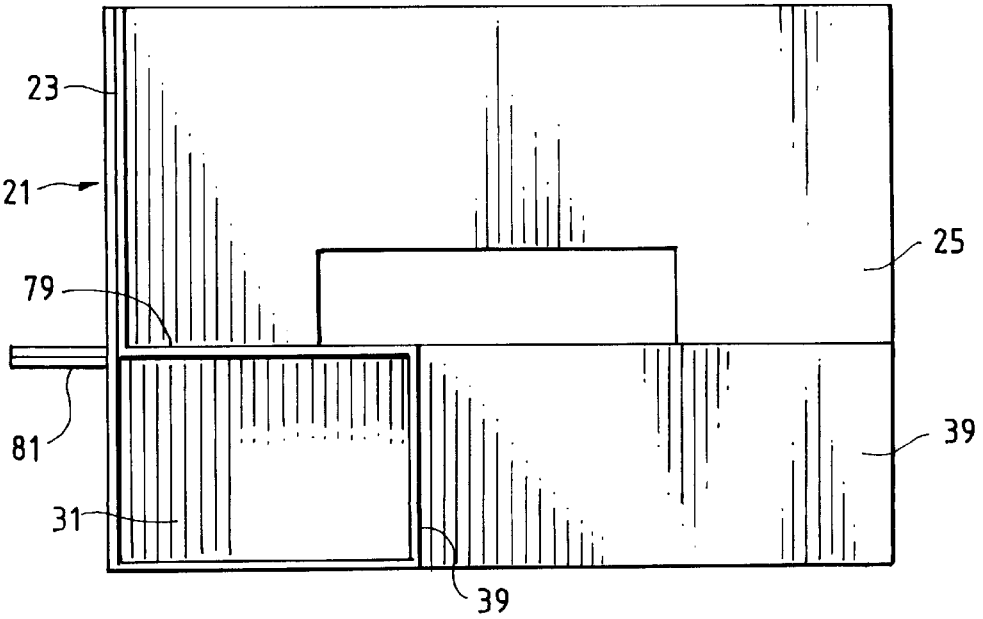

Longitudinal axis 63 shown in FIGS. 2 and 3 is located at one of the side edges when the blank 45 is glued and folded as shown in FIG. 4. To deploy the blank 45 from its collapsed state shown in FIG. 4, blank 45 is unfolded by rotating one of the outer layers 65 and its adjacent inner layer 67 away from the other pair of layers 65, 67 along axis 63. When the blank 45 is fully opened to assume the state shown in FIG. 1, longitudinal axis 63 corresponds to an outside corner 69 of bumper 21, as best seen in FIG. 6.

Each tab 33 is secured to a corresponding one of the intermediate layers 67. Tabs 33 extend transversely beyond outer layers 65 and terminate near longitudinal axis 63. As discussed previously, opposing tab surfaces 35, which are not visible in FIG. 4 but are apparent in FIG. 2, are secured to each other in the glued blank 45.

Referring now to FIGS. 2 and 3 as well as FIG. 4, a pair of fold lines 71 extends transversely along portions of blank 45. These fold lines 21 correspond to edges of the panels 29 defining hollow chamber 31. One of the transverse fold lines 71 is positioned to one side of tabs 33, while the other transverse fold line 71 is positioned to the opposite side of tabs 33. Transverse fold lines 71 are spaced from each other by a distance at least as great as the width of tabs 33. In this way, when blank 45 is erected as described more fully below, tabs 33 can be received and rotated into hollow chamber 31 where they hold the bumper in a rectilinear shape.

The unfolding of glued blank 45 occurs as follows. Walls 23 and 25 are separated from each other at their free edges 73 and rotate about axis 63 in the direction indicated by arrows B (FIG. 4). Each of the walls 23, 25 consists of one of the inner layers 67 and one of the outer layers 65. The tabs 33 on inner or intermediate layers 67 are adhered to each other at their opposing surfaces.

As such, as walls 23 and 25 are unfolded from each other, tabs 33 exert forces on panels 29 so that they extend away from the plane of walls 23, 25 and form the perimeter for hollow chamber 31 extending inwardly from walls 23, 25. The self-erecting nature of hollow chamber 31 is assisted by virtue of the transverse fold lines 71 on either side of tabs 33. In addition, another set of transverse fold lines 75 define the edges where the hollow chamber meets the planar surfaces of walls 23, 25.

In the embodiment shown the triangular voids are 90°, 45° and 45°, and as a result the walls 23, 25 are at approximately a 90° angle when the bumper is erected. The opposing edges 37 of inner panels 39 confront each other and make further outward rotation of walls 23, 25 difficult. At this point, tabs 33 can be rotated away from opposing edges 37, such as by inserting a finger into one of openings 43 as shown in FIG. 5. Tab 33 is then rotated into position over the other of circular openings 43 as discussed previously until flange 77 engages in slot 43. At that point the structure is substantially rigid.

The width of tabs 33 and their engagement within slot 43 provide a means for locking bumper 21 in the erected configuration. In particular, the tabs 33 within hollow chamber 31 inhibit collapse of hollow chamber 31, and the flange 77 received within slot 43 prevent the memory of tabs 33 from causing them to rotate back into alignment with opposing edges 37 and thereby risking collapse of bumper 21 back toward a folded flat condition.

Bumper 21 may be used to protect a corner of a substantially boxed shaped object (not shown). A pair of the panels 29 of hollow chamber 31 define horizontal shelf areas 79 on the upper periphery of hollow chamber 31. The inside region between walls 23, 25 is used to receive one of the corners of the object to be protected. The bottom corner of the object rests on shelf areas 79, whereas walls 23, 25 are adjacent to at least a portion of the sides of the object.

In addition to the advantages apparent from the foregoing description, bumper 21 and its associated blank 45 have the advantages of being easy to assemble. Glued blank 45 is readily assembled from a suitably die-cut sheet of material by using only two folding operations and two gluing operations. The glued blank 45, in turn, is readily erected merely by separating two walls 23, 25 from each other and pushing a locking tab into position.

The invention has the advantage of being easily modified, resized, or reconfigured simply by varying the size of the corrugated sheet, the pattern of die-cuts, and location of score lines. In this way, different sized objects can have bumpers 21 designed for them without a significant investment in tools and dies.

The hollow chamber 31 can optionally be used to store additional components since it is not filled with absorbent material but instead relies on its stable structure and the inherent resilience of paperboard to provide the necessary support and protection to the object.

Bumpers 21 can be equipped with a variety of additional features to enhance their protection function. For example, in the embodiments shown in FIGS. 1–7, walls 23, 25 are suitably die-cut to provide outwardly protruding spacers 81 (FIGS. 1–3). Spacers 81 are integrally connected to the panels 29 which correspond to the shelf areas 79. In this way, as hollow chamber 31 erects upon deployment of glued blank 45, spacers 81 automatically fold outwardly from the plane defined by walls 23, 25. Spacers 81 maintain walls 23, 25 separated from corresponding inner surfaces of the walls of a carton (not shown) in which the bumpers 21 and object to be protected are packaged.

Figure 8:
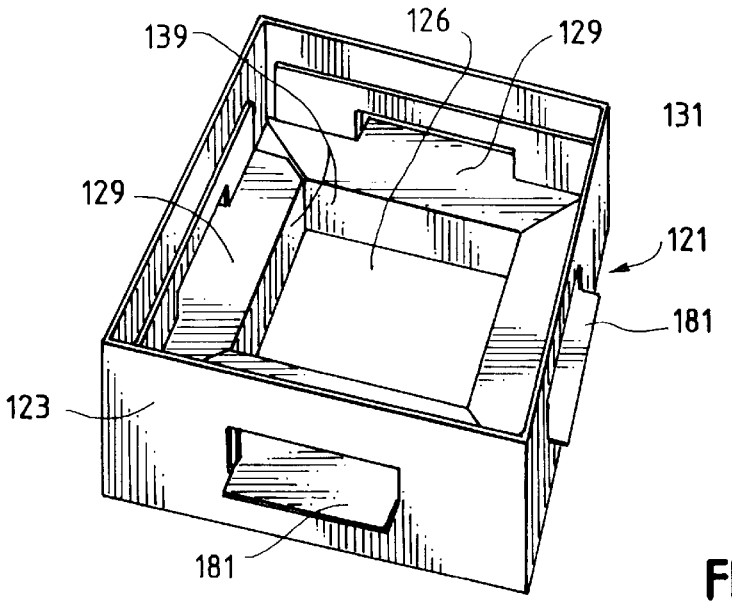
FIG. 8 is a perspective view of a second embodiment of a bumper according to the invention.

The bumper 21 shown in FIGS. 1–7 is suited for protecting a corner of a large, generally boxed-like object packed within a larger carton or box. The principles of the invention can be applied equally effectively to different bumper configurations. For example, FIGS. 8–10 disclose a bumper of corrugated material in the form of a sleeve 121. Sleeve 121 includes substantially all of the same inventive features discussed with reference to corner bumper 121 previously, and similar features have been given similar reference numerals except for the addition of 100 for the numerals of this embodiment. In effect, sleeve 121 is a series of four of the corner bumpers 21 integrated into a single bumper and blank as discussed in more detail below. Sleeve 121 includes a perimeter wall 123 enclosing a space 126 into which an object (not shown) may be placed. Similarly to bumper 121 discussed previously, a plurality of panels 129 define a hollow chamber 131 adjacent to wall 123. Hollow chamber 129 extends inwardly into enclosed space 126. Panels 129 include inner panels 139 with panel edges 137 located adjacent to each other and opposing each other.

Figure 9:
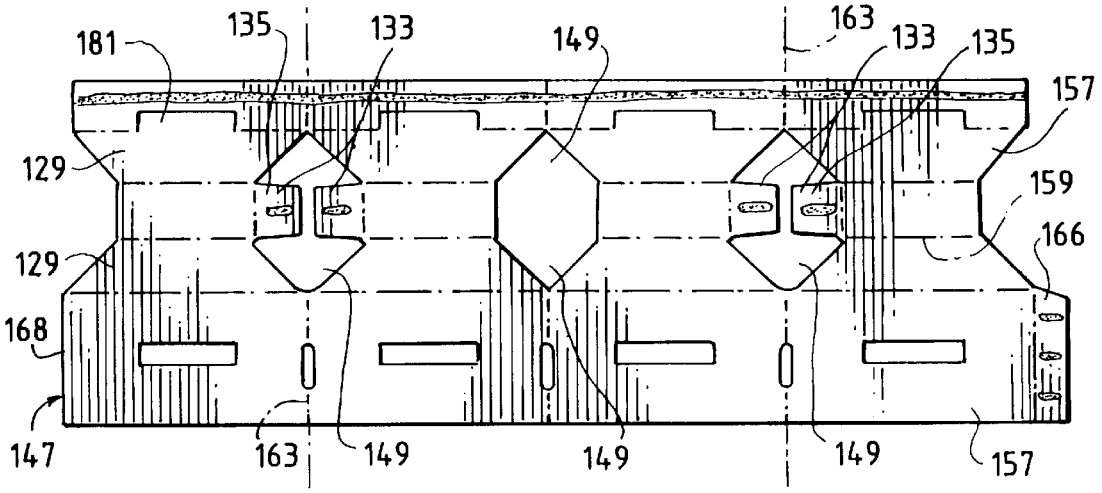
FIG. 9 is a top plan view of a sheet of material used to create the bumper shown in FIG. 8, and which has been suitably die-cut with voids and patterned with scores or perforations along fold lines.

In this embodiment, two pairs of tabs 133 extend from corresponding pairs of opposing panel edges 137 and are, adhered to each other at opposing planar surfaces 135 (FIG. 9). Tabs 133 are sized and located to be insertable into hollow chamber 131 and can be rotated so as to lock bumper 121 into a deployed position in a manner similar to that used in bumper 21. In this embodiment, however, bumper 121 does not include any slots for receiving portions of tabs 133. Instead, tabs 133 are rotated away from opposing edges 137 and are received within hollow chamber 131 to hold bumper 121 in the erected state. Bumper 121 is formed from an integral sheet of material 147 shown in FIG. 9 in a manner similar to that of bumper 21. In brief, edge regions 157 of sheet material 147 are folded toward each other and suitably adhered to each other.

Unlike bumper 21, sheet material 147 includes an additional tab 166 which is adhered to a corresponding region at the opposite edge 168 of sheet 147. Tabs 133 are provided with suitable adhesive and the side edges 161 of sheet 147 are folded toward each other along two longitudinal axes 163 to create the glued blank shown in FIG. 10.

Figure 10:
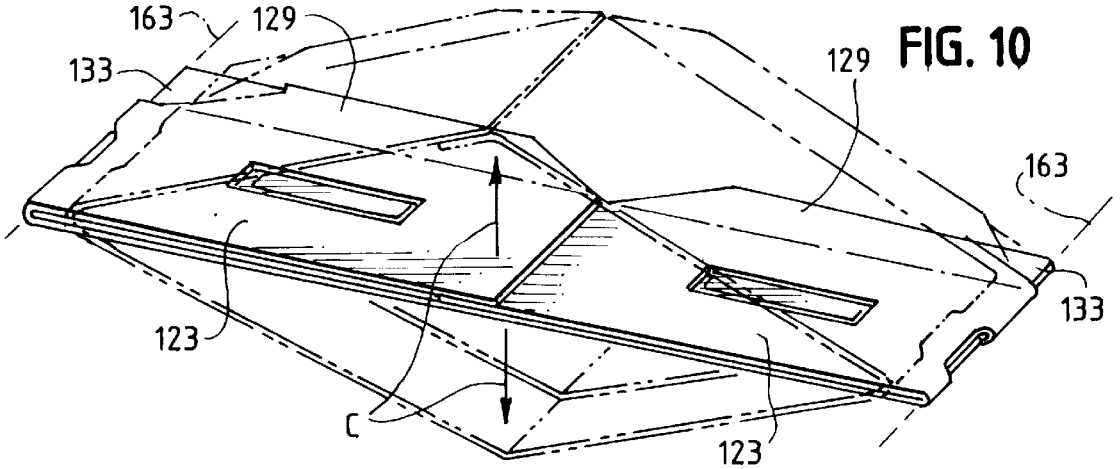
FIG. 10 shows a blank for the bumper of FIG. 8 in a perspective view.

The glued blank in FIG. 10 is in the form of a collapsed structure shown in solid lines. Outwardly directed forces in the direction of arrow C (or inwardly in a perpendicular direction) serve to partly deploy glued blank 145 as shown in phantom lines. Further outwardly directed force is applied until right angles are formed at the longitudinal axes 163 and the blank 145 assumes the erected state shown in FIG. 8.

In its erected state, sleeve 121 can receive a rectangular object within its enclosed space 126. The object an either be housed adjacent to vertical inner panels 139 or can have portions of it resting on horizontal shelf area 179. Spacers 181 extend from wall 123 in an outward direction and perform the function as described previously with reference to bumper 21.

Figure 11:
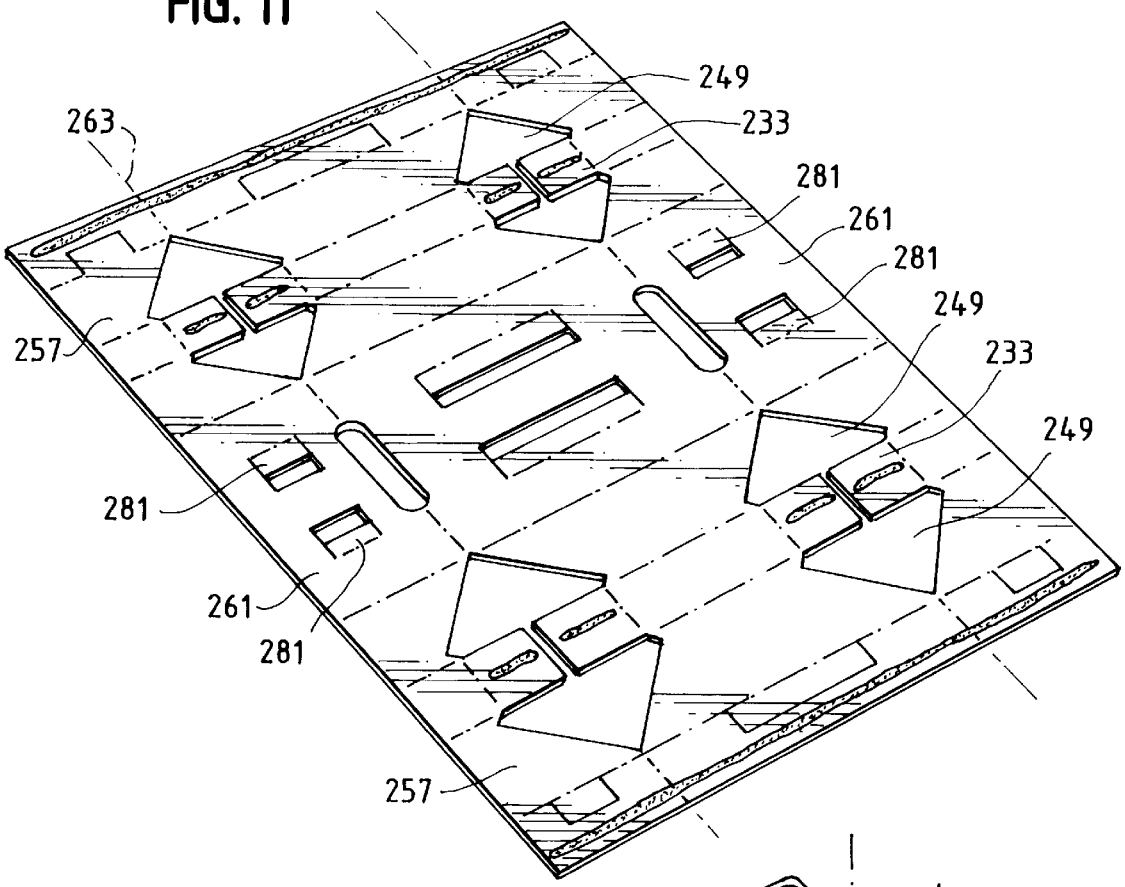
FIG. 11 shows a sheet of material used to create a third embodiment of a bumper according to the invention.
Figure 12:
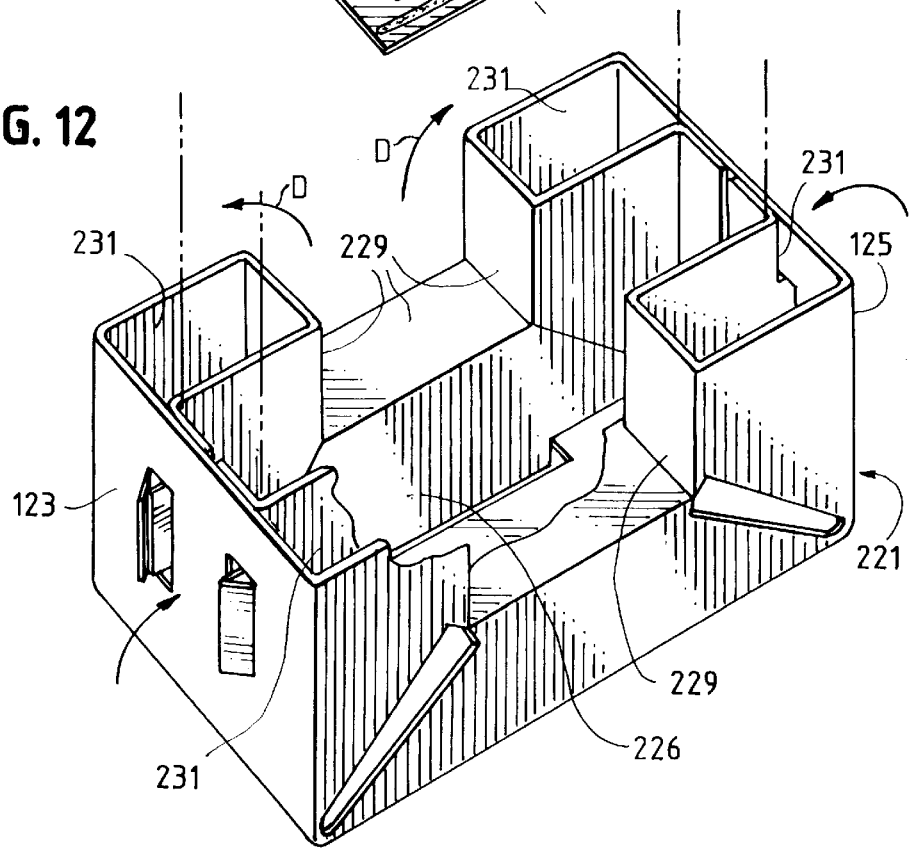
FIG. 12 shows the bumper after it has been assembled from the sheet of material of FIG. 11.

The principles of the invention can be embodied in still further alternative bumpers depending on the size and configuration of the objects to be protected. One such further alternative embodiment is shown in FIGS. 11 and 12. In this embodiment, the bumper is in the form of an end cap 221. End cap 221 includes a pair of U-shaped hollow chambers 231 which are automatically erected by outward rotation of walls 123 and 125 in the directions indicated by arrows D. As seen in FIG. 12, an end of a suitably elongated object (not shown) can be received in the space 226 defined between opposite walls 123, 125 and corresponding hollow chambers 231.

A glued blank (not shown) corresponding to end cap 221 can be formed from a sheet of material 247 shown in FIG. 11. Sheet 247 undergoes a series of folding and gluing operations similar to that discussed with reference to the two previous embodiments. Sheet material 247 has been suitably die-cut with triangular shaped voids 249. The triangular shaped voids 249 are located at opposite sides of corresponding pairs of tabs 233. Edge regions 257 are provided with a suitable pattern of adhesive and folded toward each other until they contact and are secured to each other. Side edges 261 of sheet 247 are folded toward each other so that planar surfaces 235 of tabs 233 are brought into substantial contact with each other and suitable adhesive secures the opposing surfaces of tabs 233 to each other.

The above-described embodiments can be formed from any grade of corrugated material with any-designated fluting. However, it is normally preferable to orient the fluting parallel to the direction of the greatest expected loading.

A right angle gluer is generally not required to create the glued blanks of the invention. Instead, a straight line gluer, suitably adjusted to fold layers over when required, also can be used.

The invention, having been disclosed in connection with the foregoing variations and examples, is susceptible to additional variations which would be apparent to persons skilled in the art. The invention is not intended to be limited to the variations specifically described above, and reference should be made to the appended claims rather than the foregoing discussion to assess the scope of the invention in which exclusive rights are claimed.

What is claimed is:

1. A blank for a paperboard bumper, the blank comprising:

at least two outer layers of sheet material and at least two intermediate layers between the outer layers, the four layers substantially overlying each other when the blank is in a collapsed state so that the blank is substantially flat;

a first fold line extending longitudinally across the blank and defining a longitudinal axis, the blank folding and unfolding along the longitudinal axis, the fold line corresponding to an outside corner of the blank when the blank is erected;

a tab secured to each of the intermediate layers, the tabs extending transversely beyond the outer layers and terminating proximate to the longitudinal axis, the tabs having opposing planar surfaces secured to each other;

wherein the intermediate layers are glued to the outer layers at respective opposing surfaces thereof to form first and second walls when the blank is erected;

a pair of transverse fold lines extending on the walls, one transverse fold line positioned to one side of the tabs, the other transverse fold line positioned to the opposite side of the tabs;

a hollow chamber having edges defined by the transverse fold lines and extending adjacent to the walls, the hollow chamber being formed when the blank is unfolded along the longitudinal fold line.

2. The blank of claim 1, wherein the transverse fold lines are spaced from each other by a distance at least as great as the width of the tabs, so that the tabs are receivable within the hollow chamber.

3. The blank of claim 2, further comprising non-adhesive means for locking the blank in the erected state.

4. The blank of claim 3, wherein the locking means comprises an aperture in communication with the hollow chamber and a flange extending from the tabs, the flange being engageable in the aperture.

5. The blank of claim 1, wherein the walls comprise inner and outer surfaces when erected, and further comprising spacers extending outwardly from the outer surfaces of the walls.

6. The blank of claim 1, wherein the blank comprises four corners when erected, and wherein the tabs are located at one of the four corners.

7. The blank of claim 1, wherein the fold line corresponds to a first edge of the blank, wherein the first and second walls are connected at the first edge, and wherein the first and second walls extend from the first edge, each of the walls terminating in a free edge, the free edges being rotatable radially in relation to the fold line to define an interior angle adapted to receive a corner of an object to be protected.

8. The blank of claim 1, wherein the blank comprises a pair of the longitudinal fold lines, one fold line at each of two opposite edges of the blank, the first and second walls extending from respective fold lines, a third wall extending between the fold lines, the first, second and third walls and the fold lines defining a cavity adapted to receive an end of an object to be protected.

9. The blank of claim 8, wherein each of the walls has transverse fold lines extending from a corresponding one of the longitudinal fold lines to define one of the hollow chambers adjacent to each of the walls.

10. The blank of claim 8, wherein the walls comprise inner and outer surfaces, each of the walls including a spacer extending outwardly from the outer surface.

11. The blank of claim 1, wherein the blank comprises four of the longitudinal fold lines and four of the walls extending between respective pairs of the fold lines to define an enclosed region for receiving an object to be protected.

12. The blank of claim 11, wherein each of the walls has transverse fold lines extending between a pair of the longitudinal fold lines to define one of the hollow chambers adjacent to each of the walls.

13. The blank of claim 12, wherein the walls comprise inner and outer surfaces, each of the walls including a spacer extending outwardly from the outer surface.

14. A corrugated bumper for protecting an object, the bumper comprising:

first and second walls connected to each other at a common edge;

a plurality of panels defining a hollow chamber adjacent to the walls;

a tab defined in each of the walls, the tabs extending substantially toward the common edge, the tabs being adhered to each other at opposing planar surfaces thereof, the tabs sized and located to be insertable into the hollow chamber to lock the bumper in an erected position.

15. The corrugated bumper of claim 14, wherein the first and second walls comprise interior and exterior surfaces, wherein the hollow chamber extends inwardly from the interior surfaces, the chamber being located at the bases of the first and second walls, the walls extending beyond the perimeter of the chamber, wherein the panels define a shelf area oriented substantially horizontally when the first and second walls are substantially vertical.

16. A corrugated bumper for protecting an object, the bumper comprising:

a wall having a base, an upper edge and interior and exterior wall surface, the wall enclosing a space into which the object may be placed;

a plurality of panels defining a hollow chamber adjacent to the wall, the hollow chamber extending inwardly into the enclosed space, the panels including inner panels having substantially the same orientation as the wall, the inner panels located adjacent to each other and having respective pairs of opposing panel edges;

a pair of tabs extending from at least one pair of opposing panel edges, the tabs being adhered to each other at opposing planar surfaces thereof, the tabs sized and located to be insertable into the hollow chamber to lock the bumper in an erected position.

17. The corrugated bumper of claim 16, wherein the wall comprises four wall portions connected at substantially right angles to each other to define a rectangular enclosed space.

18. The corrugated bumper of claim 17, wherein the chamber is located at the base of the wall 19.

19. The corrugated bumper of claim 17, wherein the panels define a shelf area oriented substantially horizontally when the wall is substantially vertical.

* * * * *